US005342265A

United States Patent [19]

Creelman et al.

[11] Patent Number: 5,342,265

[45] Date of Patent: Aug. 30, 1994

[54] MOGOL SKIING SIMULATING EXERCISE APPARATUS WITH VARIABLE RESISTANCE

[76] Inventors: Kevin Creelman, 104 Center St. Suite 100, Kodiak, Ak. 99615; Terry G. Jacobs, NE. 18911 N. Shore Rd., Tahuya, Wash. 98588

[21] Appl. No.: 21,138

[22] Filed: Feb. 23, 1993

[51] Int. Cl.[5] ..... A63B 69/18

[52] U.S. Cl. ..... 482/71; 482/57; 482/63; 482/130

[58] Field of Search ..... 482/71, 121, 123, 129, 482/130, 133, 134, 135, 136, 137, 53, 63, 57, 64; 128/25 B

[56] References Cited

U.S. PATENT DOCUMENTS

| | | | |
|---|---|---|---|
| 3,501,142 | 3/1970 | Johansson | 482/64 |
| 3,831,935 | 8/1974 | Höfle . | |
| 4,519,603 | 5/1985 | De Cloux | 482/63 |
| 4,542,898 | 9/1985 | Grushkin | 482/71 |
| 4,641,833 | 2/1987 | Trethewam | 482/57 |
| 4,708,338 | 11/1987 | Potts . | |
| 4,842,269 | 6/1989 | Huang | 482/63 |
| 4,934,688 | 6/1990 | Lo | 482/53 |

FOREIGN PATENT DOCUMENTS

| | | |
|---|---|---|
| 1289516 | 8/1985 | U.S.S.R. . |
| 1443900 | 5/1987 | U.S.S.R. . |

*Primary Examiner*—Robert Bahr
*Assistant Examiner*—Lynne A. Reichard
*Attorney, Agent, or Firm*—Richard C. Litman

[57] ABSTRACT

An exercise apparatus especially suitable for simulating skiing conditions. The apparatus comprises a base which supports a rotatable component which, in turn, supports a platform for supporting a user. The rotational component includes a unidirectional element limiting the direction of rotation of the component. A biasing assembly assists and resists the movement and varies the speed of the rotational component in response to a displacement of the same.

10 Claims, 6 Drawing Sheets

MOGOL SKIING SIMULATING EXERCISE APPARATUS WITH VARIABLE RESISTANCE

BACKGROUND OF THE INVENTION

1. Field of the Invention

The present invention relates generally to an exercise apparatus. The apparatus is especially suitable in simulating the energy expenditure and absorption which muscle groups experience in alpine mogul skiing.

2. Description of the Prior Art

Exercising devices for conditioning muscle groups are well known. Typically, exercise devices include elemental components dimensioned and configured to interact together so as to enable and/or encourage a particular movement of one or more muscle groups. Some devices simulate environmental certain conditions, such as those conditions one encounters when skiing and climbing stairs. One such device is shown in U.S. Pat. No. 3,831,935, issued Aug. 27, 1974 to Hubert Höfle, disclosing a movable platform exercising device having two double crank arms attached to a frame. The double crank arms revolve about a horizontal axle. The inner arms of the double crank are connected to at least one movable platform upon the frame on which the user stands. Handle bars are pivotally attached to the outer arms of the double cranks. In operation, the user first stands on the platform grasping the handle bars. By shifting his or her weight the platform is caused to move in a circular motion. As the platform rises, the handle bars lower and vice versa. The motion of the platform is opposed by a plurality of springs which tend to maintain the platform in a horizontal attitude.

U.S. Pat. No. 4,708,338, issued Nov. 24, 1987 to Lanny L. Potts, discloses a stair climbing exercise apparatus including a frame having a base and a plate Joined perpendicularly to the base for reinforcing purposes. Right and left pedals adapted to support the feet of a user are disposed on opposite sides of the plate. A drive system assembly is associated with the plate and includes right and left pedal sprockets and a drive sprocket joined thereto. The right and left sprockets independently oscillate between an upper position at rest and a lower, rearward position under the weight of the user. A continuous chain drivingly engages a transmission input and the drive sprocket. A continuous belt drivingly engages a transmission output and an alternator which acts as a dynamic brake.

Soviet Union Inventor's Certificate No. SU 1289526, issued Aug. 28, 1985, discloses a foot muscle exercise apparatus having a frame attached to a seat. The frame contains a platform for each foot of the user. The platforms are Joined to the frame by a plurality of springs disposed at desperate angles.

Soviet Union Inventor's Certificate No. SU 1443900, issued May 12, 1987, discloses a leg Joint exerciser including a plurality of articulated rods having means to respectively attach the same to the thigh, the lower leg, and the foot of the user. A first rod, attached to the thigh, is pivotally connected to a frame and linked via a first connecting rod and crank to a drive shaft. A second connecting rod pivotally connects the first connecting rod to a second rod, attached to the lower leg. A third connecting rod pivotally connects the second connecting rod to the rear end of the rod attached to the foot.

None of the above inventions and patents, taken either singly or in combination, is seen to describe the instant invention as claimed.

SUMMARY OF THE INVENTION

The present invention relates to an exercise apparatus especially suitable for simulating skiing conditions. The apparatus comprises a base which supports a rotatable crank assembly. A platform for supporting the feet of a user rotatably engages the crank assembly. This engagement is accomplished by means of a unidirectional bearing which enables the platform to rotate in a reverse direction. A biasing assembly operatively couples the crank assembly to the base by way of a chain carried by an offset sprocket. The offset sprocket is attached to an offset shaft associated with the crank assembly. The biasing assembly applies a rotational force upon the crank assembly to assist and resist the rotation of the platform supporting the user. The cooperative relationship between the biasing assembly and the crank assembly varies the speed of the rotation of the sprocket and, in turn, the crank assembly with respect to the position of the same. Hence, the rotational force applied and the leverage required to induce the motion of the platform varies in accordance with the relative position of the platform. To provide the user stability in the course of the apparatus, handles are secured to the base.

Accordingly, it is a principal object of the invention to provide an exercise apparatus having a rotational component especially suitable for simulating skiing conditions.

It is another object to incorporate an unidirectional element which restricts the movement of the rotational component.

It is a further object that the rotational component apply a rotational force that both assists and resists the user in the rotational movement of the same.

Still another object is vary the speed of the rotational movement the rotational component with respect to the displacement of the same.

Another object is to provide a user with an element of physical stability.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding-features consistently throughout the attached drawings.

DETAILED DESCRIPTION OF THE PREFERRED EMBODIMENT

Figure 1:
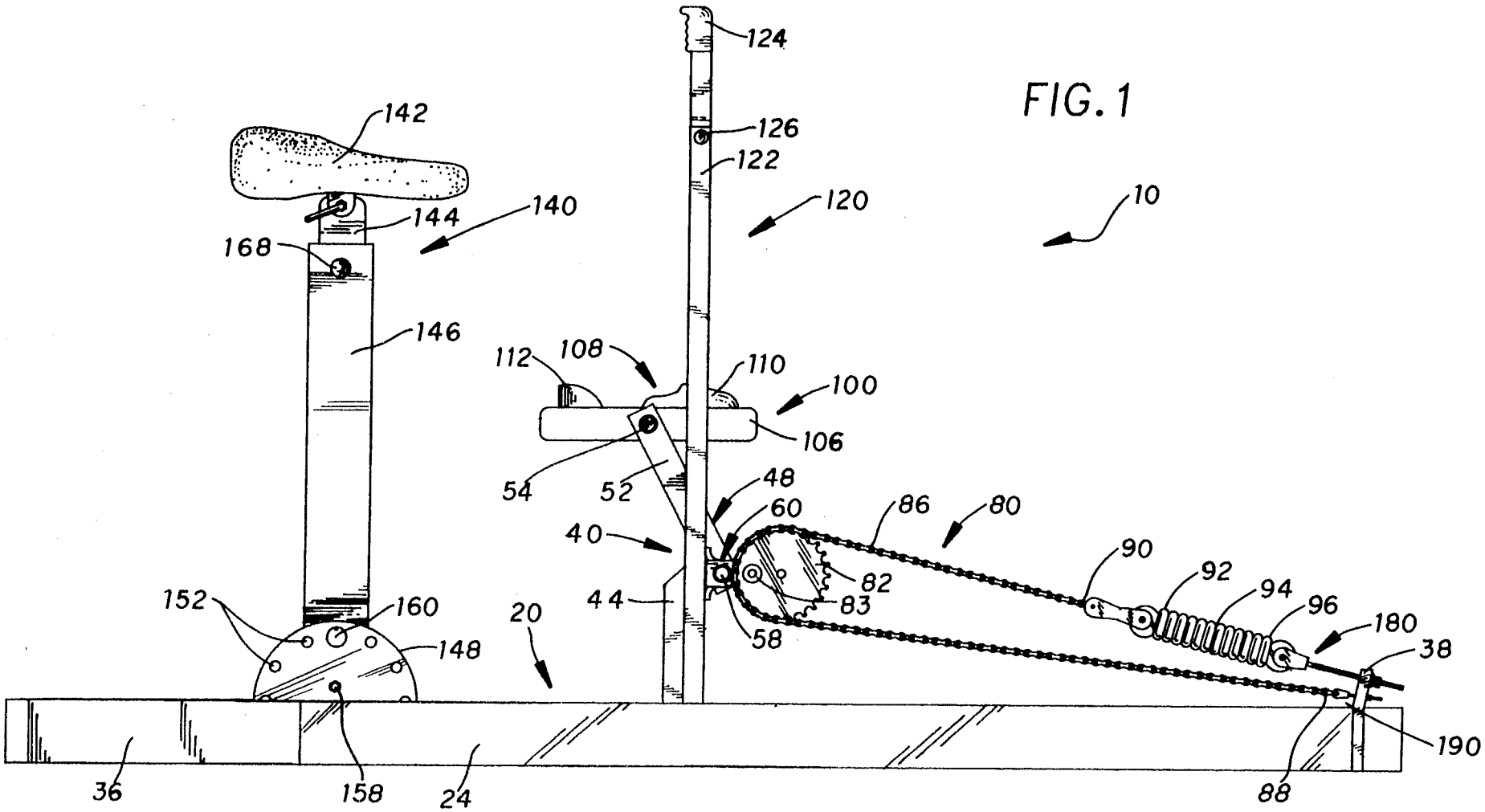
FIG. 1 is a side elevation view of an exercise apparatus in accordance with the present invention.
Figure 2:
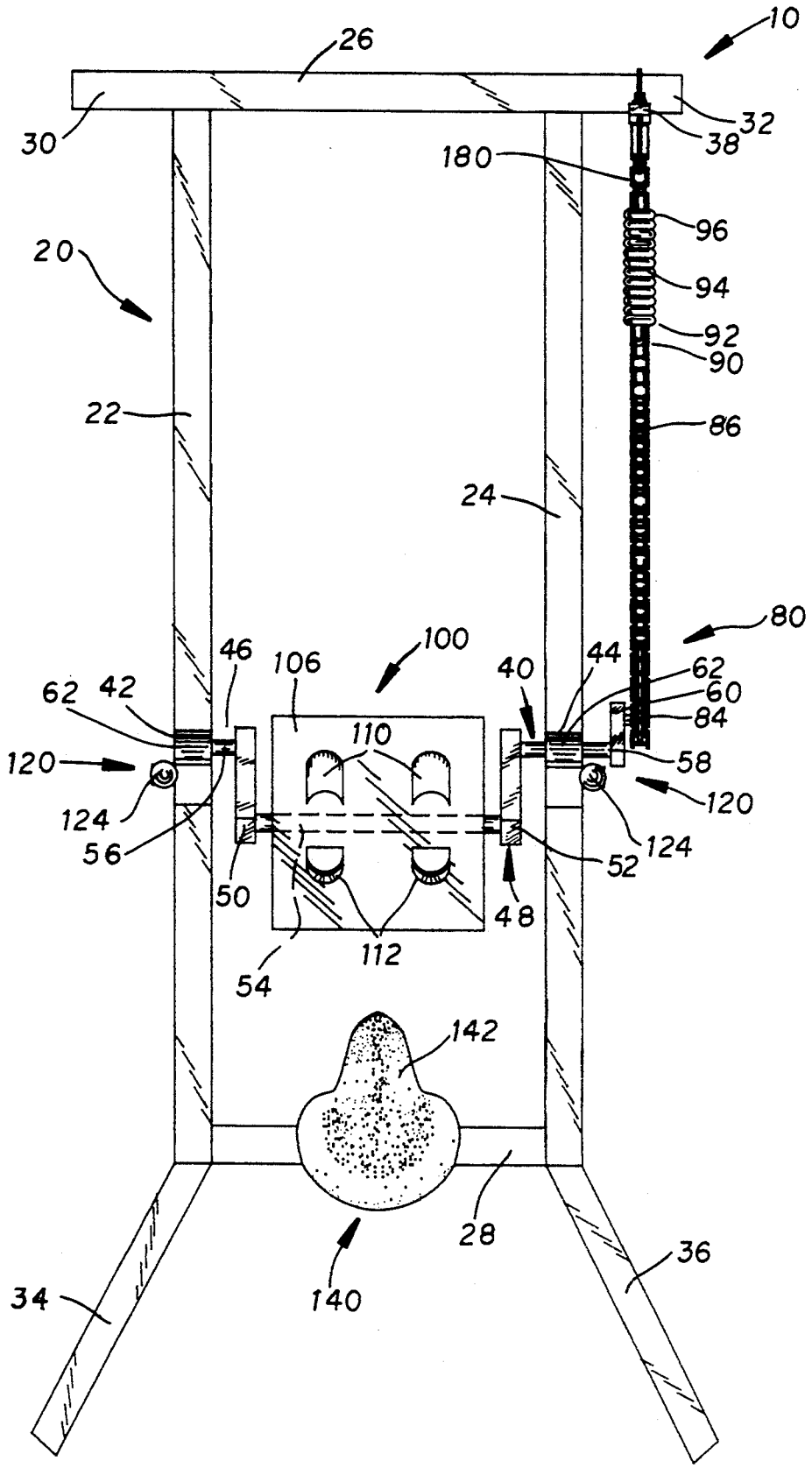
FIG. 2 is a top plan of the exercise apparatus shown in FIG. 1.

The present invention, as shown in FIGS. 1 and 2, is an exercise apparatus 10. The apparatus 10 is particularly useful simulating mogul skiing and in the training and conditioning of the muscle groups that a skier uses when skiing moguls by simulating the energy expenditure and absorption the muscle groups must use. The apparatus 10 includes: a base 20, a crank assembly 40, a biasing assembly 80, a platform 100, and two handles 120.

The base 20 comprises left and right longitudinal rods 22, 24 positioned in a spaced apart relationship and substantially parallel with one another. The left and right longitudinal rods 22, 24 are connected by front and rear laterally-extending rods 26, 28 also positioned in a spaced apart relationship and substantially parallel with one another. This orientation of these rods 22, 24, 26, 28 forms a substantially rectangular, planar frame structure. The front laterally extending rod 26 has joined thereto a left and right horizontally disposed, laterally extending extension segments 30, 32 which respectively extend perpendicularly beyond the left and right longitudinal rods 22, 24. The left and right extension segments 30, 32-cooperatively provide supplemental stability about the longitudinal axis of the base 20. Joined obliquely to the rear laterally extending rod 28 are left and right horizontally disposed extensions 34, 36, each extending in opposing directions. Horizontally disposed extensions 34, 36 provide supplemental support and stability in both the longitudinal and lateral directions of the base 20. The base 20 may be assembled through conventional welding methods or a threaded fastener arrangement (neither of which are shown). It should be noted that the dimensions of the base 20 must be suitable to sustain a user (not shown) in an upright orientation during the operation of the apparatus 10.

The crank assembly 40, biasing assembly 80, and handles 100 are all supported by the base 20. The crank assembly 40 is rotatably joined to the base 20. The base 20 is comprised of left and right vertical support elements 42, 44 having rotatably joined thereto a first crank, referred to as a left crank 46, and a second crank, referred to as a right crank 48, respectively. The left crank 46 is laterally spaced apart from, and axially aligned with, the second crank 48. Each crank 46, 48 is provided with an inner arm 50, 52. Each inner arm 50, 52 is disposed in a plane positioned substantially parallel to the left and right longitudinal rods 22, 24. The inner arms 50, 52 are oppositely disposed in a coplanar arrangement with respect to one another and are joined together by a laterally disposed connecting rod 54. The connecting rod 54 is fixedly attached to each inner arm 46, 48 so as to maintain the coplanar orientation of the inner arms 50, 52. The attachment may be accomplished through a conventional welding method, a press fit, or through matingly engagable male and female threads (none of which are shown). Extending outwardly and substantially perpendicularly from each inner arm 50, 52 is a bearing support element 56, 58. The bearing supports 56, 58, respectively, carry first and second unidirectional bearings 62. The unidirectional bearings 62 are of the conventional type, such as roller clutch bearing, part number ROB121616, manufactured by Torrington Fafner of Torrington, Conn. The unidirectional bearings 62 join the crank assembly 40 to the base 20 and are permitted to roll in a single direction and thus, limit the rotation of the crank assembly 40 to a single direction, such as a reverse bicycle pedaling motion. The unidirectional bearings 62 permit each crank 46, 48 to be rotatably supported by its respective vertical support element 42, 44. As shown in the drawings and more particularly, in FIG. 2, the right crank 48 is inclusive of an outer arm 60. The inner and outer arms 52, 60 of the right crank 48 are disposed in planes substantially parallel relative to one another and extend in opposing directions from their juncture. The inner and outer arms 52, 60 have adjacent ends joined together by a bearing support element 58 so as to produce the serpentine or S-shaped configuration shown. It should be clear to one skilled in the art that either or both cranks 46, 48 may include an outer arm for the purposes intended as will be made apparent through the description of the biasing assembly 80 disclosed hereinafter.

Figure 8A:
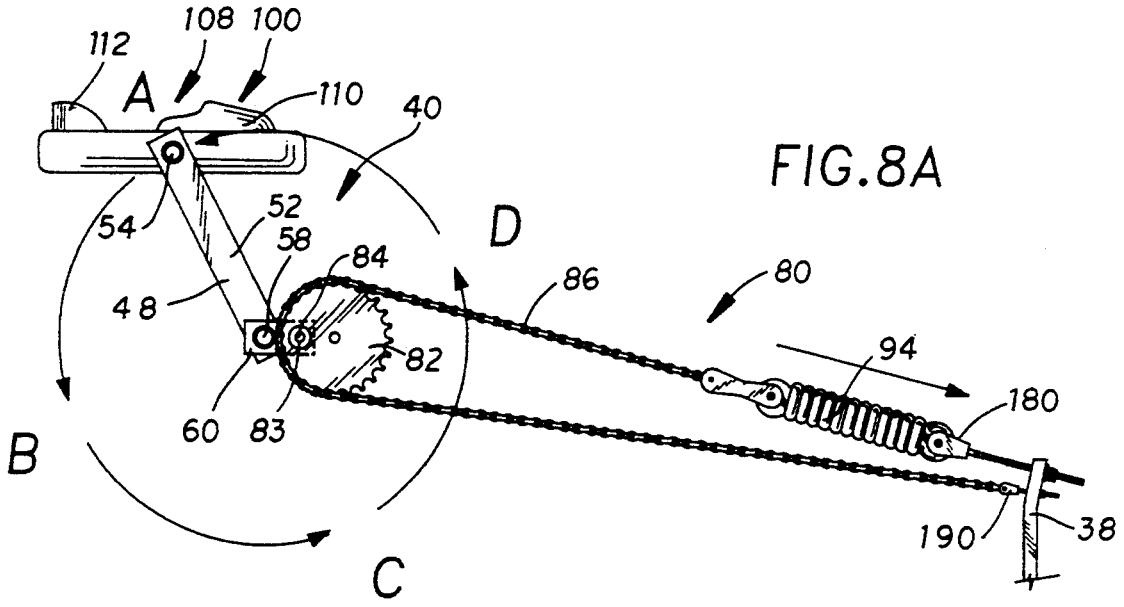
FIG. 8A and 8B are diagrammatic representations showing variations in the displacement of the biasing assembly relative to the rotational position of the platform.
Figure 8B:
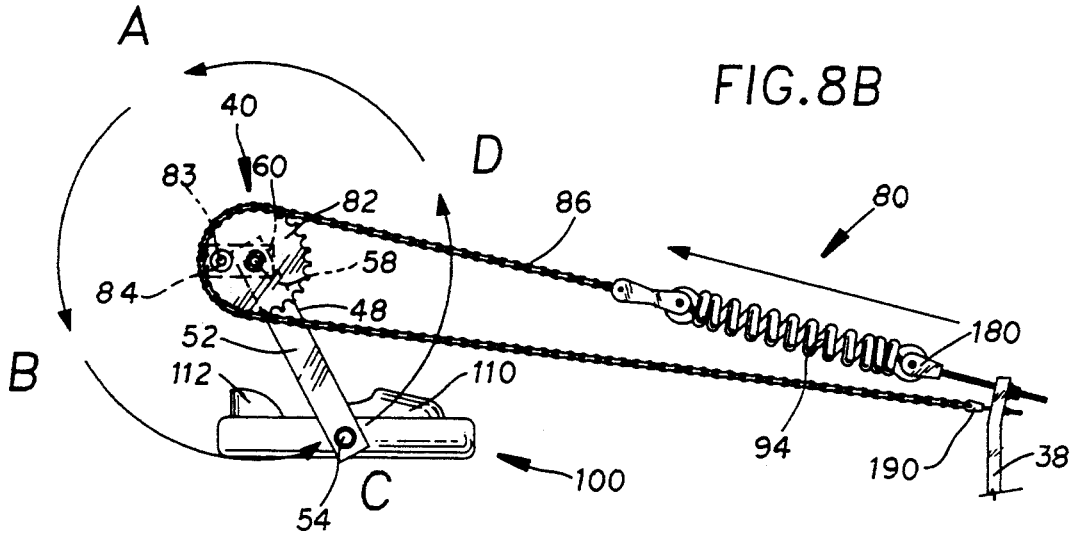

The biasing assembly 80 is operatively coupled to the crank assembly 40 and the base 20. A rotational force is produced by the biasing assembly 80 and applied to the crank assembly 40. The rotational force is variable in accordance with a relative position of the crank assembly 40. The biasing assembly 80 includes an sprocket 82 for applying the rotational force to the crank assembly 40. The sprocket 82 has an offset hub 83 rotatably engaging an offset shaft 84 which projects outwardly and substantially perpendicularly from the outer arm 60 of the right crank 48 so as to orbit about the axis of rotation of the left and right cranks 46, 48. The sprocket 82 may be movably mounted to the shaft 84 in some well known conventional manner. A bearing or a bushing (not shown) may be carried between the shaft 84 and the offset hub 83 of the sprocket 82 to reduce wear and friction between the shaft 82 and the offset hub 83 and, in turn, reduce maintenance requirements of the same. The sprocket 82 is meshingly engaged by a first segment of a chain 86. The chain 90 delivers the rotational force to the sprocket 82. The chain 86 has a distal end 88 and a proximal end 90. The distal end 88 of the chain 86 is joined to an anchor 38 located at a forward end of the base 20 and the proximal end 90 thereof, or a second segment, is connected to the anchor 38 attached to the base 20 via a tension spring 94. A proximal end 92 of a tension spring 94 is connected to the proximal end 90 of the chain 86 and a distal end 96 of the tension spring 94 is joined to the anchor 38 in the same vicinity as the distal end 88 of the chain 86. The spring 94 produces the rotational force being applied to the crank assembly 40. As the crank assembly 40 rotates about its axis of rotation, as shown in FIGS. 8A and 8B, the offset sprocket 82 orbits around the .same axis of rotation, in turn, movably carrying the chain 86 and oscillating the tension spring 94 between a state of relaxation and flexion. As will be disclosed hereinafter, the oscillation of the tension spring 94 assists and resists the rotation of the crank assembly 40 depending on the relative position of the same. Preferably, the respective ends 96, 88 of the spring 94 and the chain 86 each have attached thereto a separate turn buckle 180, 190 (see also FIG. 9). The turn buckles 180, 190 engage the base 20 and permit the user to adjust the rotational force applied to the sprocket 82 and, in turn, applied to the crank assembly 40.

Figure 3:
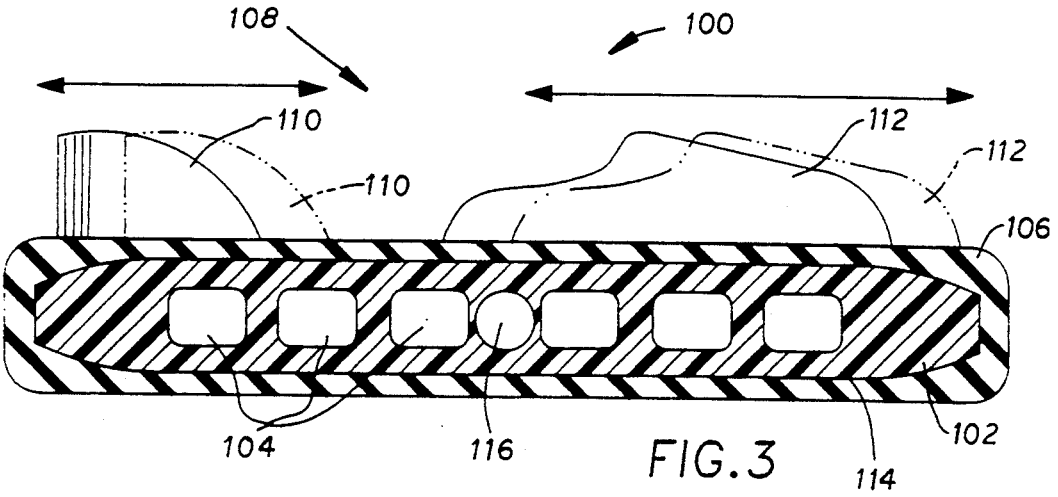
FIG. 3 is a cross sectional view of the platform.

Referring now to FIGS. 1, 2 and 3, the laterally extending connecting rod 54 joining the left and right cranks 46, 48 passes through a passage 72 in the platform 100 so as to rotatably engage the platform 100 and the crank assembly 40. The platform 100 is rotatable so as to be permitted to maintain a constant relative attitude, such as the horizontal attitude shown in FIG. 1, as the laterally extending connecting rod 54 and platform 100 alike orbit about the axis of rotation of the crank assembly 40. The platform 100 supports a user and may assume various attitudes, such as an inclined posture (not shown) which is more suitable if the user chooses to sit on the seat 142. The platform 100 is comprised of a rigid core 102 having an aperture therein to permit the passage of the laterally extending connecting rod 54 therethrough. The rigid core 102 is capable of sustaining the weight of the user. Preferably, the rigid core 102 is fabricated of a fiberglass material so as to reduce manufacturing cost. To further reduce manufacturing costs, a reduction in fiberglass material required may be achieved by providing hollow areas 104 in the rigid core 102. It should be noted that other materials, such as aluminum, would produce a like effect. To reduce the risk of harm to the user, preferably a padding material 106, such as the rubber padding shown in the drawings, is Joined to the outer surface 114 of the platform 100. If the user were to become inadvertently removed from the platform 100 through the motion of the crank assembly 40, the padding 106 would protect the user against direct impact with the rigid core 102. To further reduce the risk of injury to the user, left and right boots 108, each comprising a heel and toe portion 110, 112, are positioned atop the platform 100 to receive and retain a respective foot (not shown) of the user. Preferably, the heel and toe portions 110, 122 are movably attached to the platform 100, such as through some conventional slidably adjustable arrangement (not shown). The heel portions 110 and/or the toe portions 112 may be adjusted in the longitudinal direction so as to further ensure the retention of the feet of the user. Each boot 108 is preferably produced from a resilient material which provides comfort and conforms snugly to the shape of a respective foot of the user.

Figure 7:
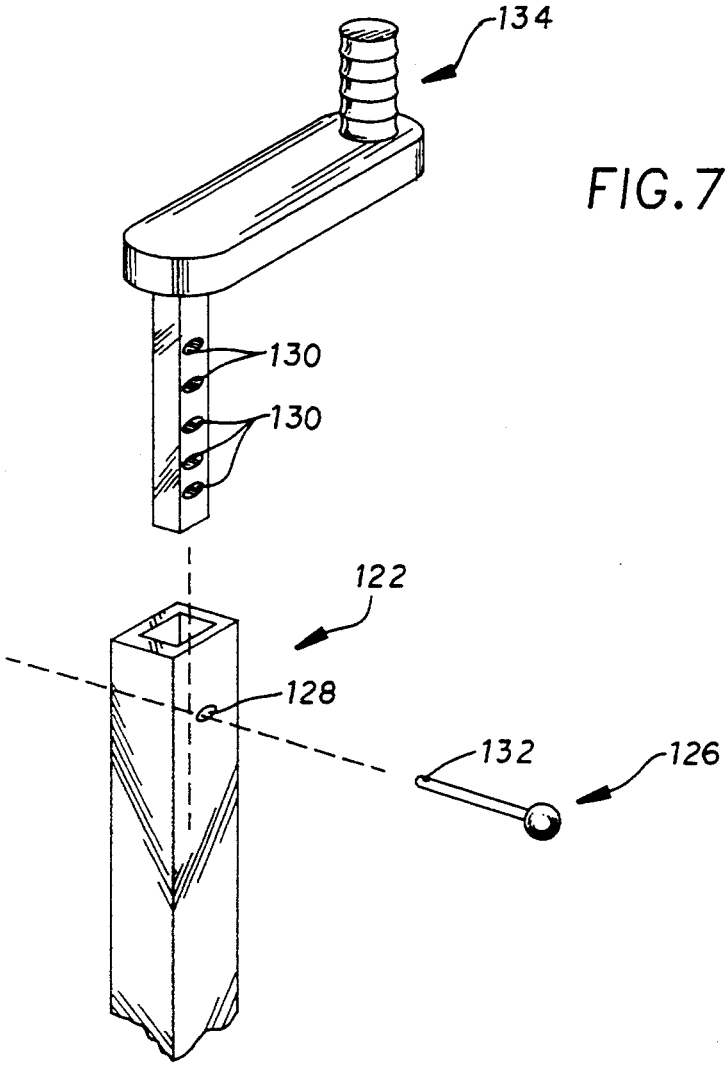
FIG. 7 is a partially exploded, partial front elevational view of an alternative hand grip.

Focusing again on FIG. 1, the left and right handles 120 are provided for a user to grasp. Each handle 120 includes a standard 122 and a hand grip 124. The standards 120 are rigidly secured to and extend upwardly from the base 20. Specifically, the left and right handles 120 are connected, respectively, to the left and right elongated rods 22, 24 in a fashion similar to that in the aforementioned description directed toward the assembly of the base 20, that is, through a conventional welding method or through the use of threaded fasteners (not shown). The handles 120 provide stability for the user during the operation of the apparatus 10. The handle grips 124 slidably engage an upper end of the standards 122 so as to permit the height of the hand gripe 124 to be adjusted or varied in accordance with the size and the posture of the user. The cooperative engagement of each hand grip 124 with its respective standard 122 may be fixed via the slidable engagement of a pin 126 through an aperture 128 in the standard 122 and any one of the array of apertures 130 in the hand grip 124 which axially aligns with the aperture 128 in the standard 122. The pin 126 may be of the conventional type including a recessable, spring biased ball 132 (construction details thereof not provided) located in the tip thereof. The spring biased ball 132 would prevent the pin 126 from being accidentally dislodged from the apertures 128, 130. The hand grip 124 shown in FIG. I is preferred when a user assumes a seated posture. However, FIG. 7 shows an alternative hand grip 134 which is more suitable for when the user assumes a standing posture. One hand grip 124 may be replaced with the other hand grip 134, for example, by removing the pin 126, removing the undesired hand grip 124 from the standard 122, inserting the desired hand grip 134 into the standard 122, and reinserting the pin 126 through the apertures 128, 130.

Figure 4:
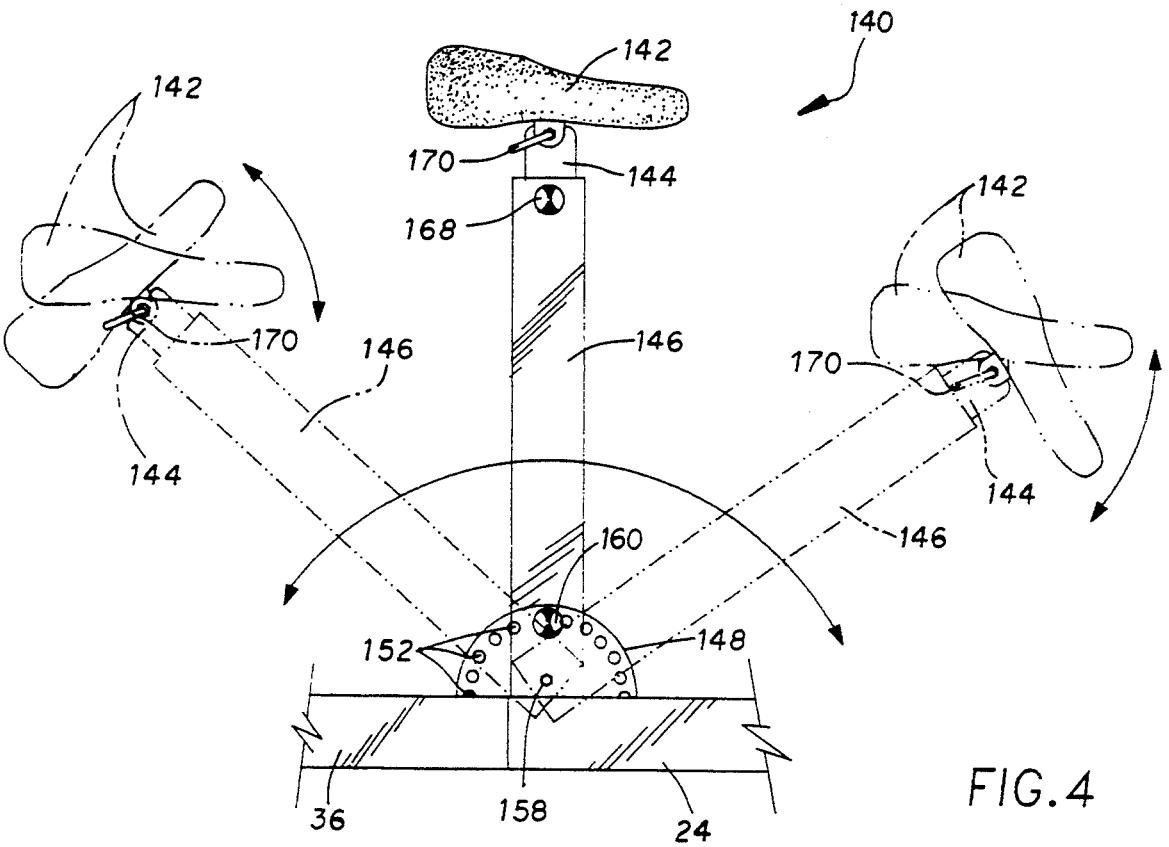
FIG. 4 is a partial side elevational view of the exercise apparatus shown in FIG. 1 showing the pivotal adjustment of the seat assembly in phantom lines.
Figure 5:
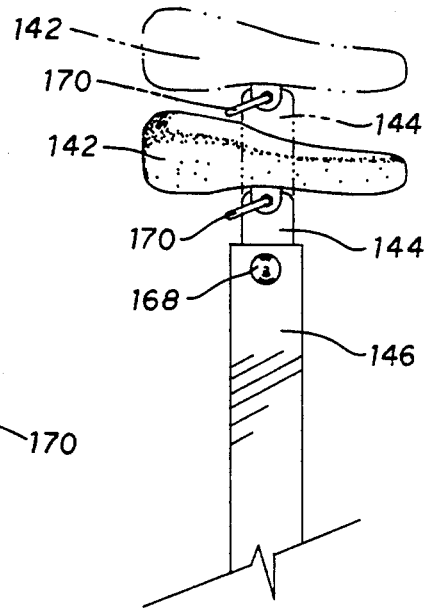
FIG. 5 is a partial side elevational view of the seat assembly shown in FIG. 4 showing the vertical adjustment of the seat assembly in phantom lines.
Figure 6:
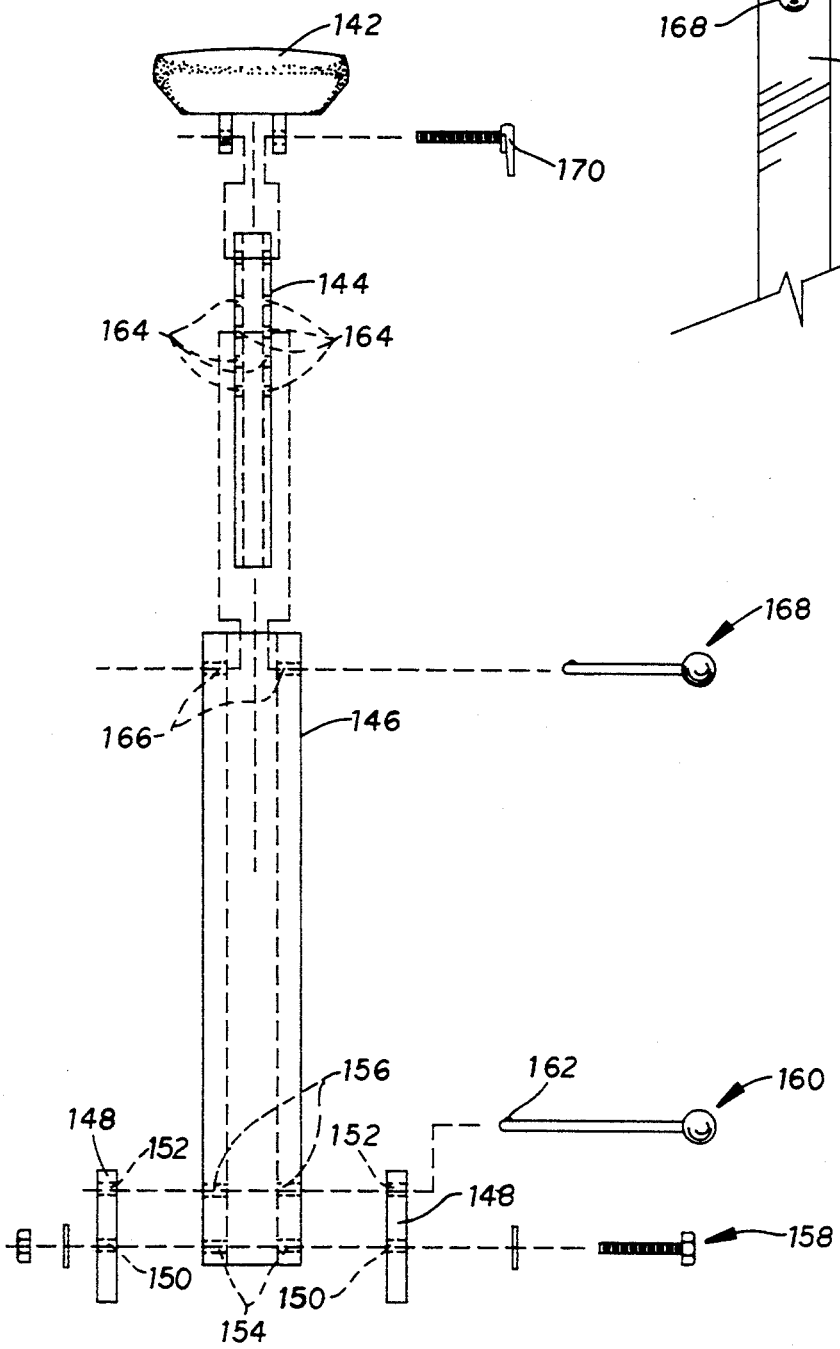
FIG. 6 is a partially exploded, partial rear elevational view of the seat assembly shown in FIG. 4.

Referring now to FIGS. i and 2, and FIGS. 4 through 6, showing a removable seat assembly 140 for supporting a user's upper body. The seat assembly 140 is attachable to the base 20. The seat assembly 140 includes a seat 142 attachable to an upper end of a staff 146. The seat 142 and the staff 146 are preferably connected together by a seat post 144. The staff 146 facilitates in supporting the seat 142. The seat 142 is attached to the upper end of the seat post 144 via a pivotally adjustable fastener. The seat post 144 may be slidably engagable with a staff 146 and is adjustable to vary the height of the seat 142. A lower end of the staff 146 is removably attachable to the base 20 at the rear lateral extension rod 28. The base 20 has a left and right semi-circular plate 148 spaced apart and affixed to the rear lateral rod 28 proximate its mid point. Each plate 148 includes a centrally disposed hole 150 and a plurality of holes 152 disposed about the periphery of the semi-circular plate 148. Spaced apart openings 154, 156 are provided in the lower end of the staff 146. These openings 154, 156 align correspondingly with the holes 150, 152 in the plates 148. The staff 146 is pivotally connected between the two plates 148 by a fastener 158, such as the threaded fastener shown, insertable through the centrally disposed hole 150 and the lowermost opening in the staff 154. This pivotal attachment allows the staff 146 to be adjusted radially along a longitudinal axis and in accordance with a user's preference, as shown in FIG. 4. Once a desired disposition of the staff 148 has been achieved, a pin 160 is insertable through a respective one of the plurality of holes 152 in each of the semi-circular plates 148 as well as through the uppermost opening 156 in the lower end of staff 146 disposed therebetween. The pin 160 maintains the staff 146 in its chosen posture. Similar to the pin 126 associated with the handles 120, this pin 160 may be provided with a spring biased ball (construction details thereof not provided) 162.

To maintain a horizonal displacement of the seat 142 in the various positions of the staff 148, located on the bottom of the seat 142 is the pivotal attachment which is cooperatively and pivotally attached to the seat post 144, such as through the use of a conventional quick release threaded fastener 170 shown more clearly in FIG. 6.

Moreover, to accommodate users of various sizes, the height of the seat 142 is adjustable, as shown in FIGS. 5 and 6, by way of the telescopic engagement of the seat post 144 and the staff 146. A plurality of holes 164 are provided along the length of the seat post 144 which are selectively alignable with an opening 166 in the staff 146. A pin 168 is engagable with the corresponding hole 164 and opening 166 in a manner similar to that which maintains the hand grip 124, 134 and the radial positioning of the staff 146.

The operation of the apparatus 10 is as follows. The feet of the user are supported by the platform 100 and may be utilized to apply force to displace the crank assembly 40 in a reverse bicycle motion, as shown in FIGS. 8A and 8B, in response to a kick cam action of the crank assembly 40. A kick cam action is an action which accumulates energy throughout one half cycle of the counterclockwise rotation of the crank assembly 40 from point A to point B to point C and delivers energy in an aggressive force throughout the second half cycle of the counterclockwise rotation from point C to point D back to point A to encourage the users legs to bend. The configuration of the crank assembly 40 and the biasing assembly 80, particularly the sprocket 82 configuration, and the interaction of the same distributes the biasing forces throughout the arc of a circle, simulating mogul skiing conditions.

Initially, the platform 100 is at rest at position A shown in FIG. 8A. The condition simulated is the mogul top where the legs are bent. The tension spring 94 is relaxed and thus, the forces are diminished. The platform 100 rotates counterclockwise one full cycle. The full cycle of rotation is defined by two half cycles. One half cycle is defined by a downward stroke. The downward stroke occurs between points A and C of the counterclockwise rotation. The other half cycle is defined by an upward stroke. The upward stroke occurs between points C and A of the counterclockwise rotation. As the platform 100 rotates counterclockwise from point A to point B, the condition simulated is the mogul front. The user's legs begin to extend and a moderate amount of resistance is felt. As the platform 100 continues to rotate counterclockwise and approaches point C from point B, the user's legs fully extend, pushing downward and foreword, counteracting the force of the tension spring 94. As the platform 100 passes the threshold of point C and continues to rotate counterclockwise past point D, returning to point A, the mogul backside condition is simulated. The tension spring 94 aggressively pushes the legs into a bent posture. The kick cam action releases the energy from the tension spring 94 to be absorbed by the user's legs as the legs assume a bent attitude. In summary, when the crank assembly 40 is rotated by the user, the sprocket 82 is forced to revolve towards the fixed end of the chain 86. The offset hub 83 causes the sprocket 82 to rotate at varying speeds relative to the position of the crank assembly 40. Over the displacement of the crank assembly 40, the leverage applied by the tension spring 94 varies.

Figure 9:
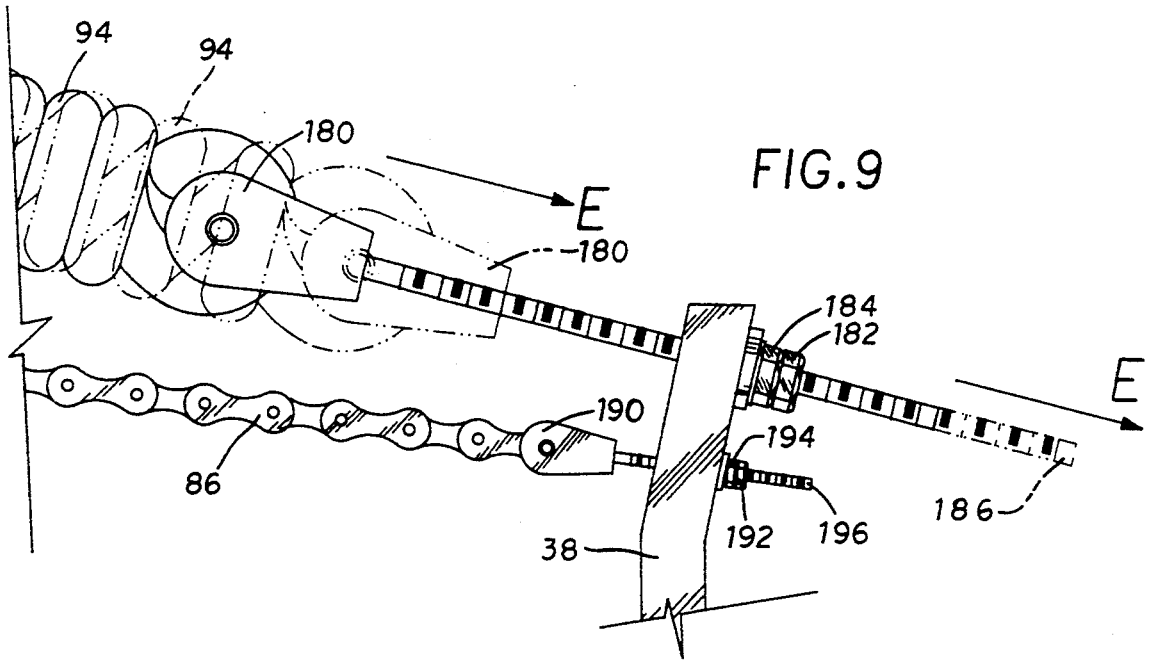
FIG. 9 is a side elevational view of the spring tension adjustment mechanism of the biasing assembly.

Preferably, the tension spring 94, the chain 86, or both are coupled to the anchor 38 by means of separate turnbuckles 180, 190 shown particularly in FIG. 9. The energy delivered from the tension spring 94 to the crank assembly 40 is varied by loosening the lock nut 182, 192 free from contact with the tension nut 184, 194 and turning the tension nut 184, 194. For example, the tension can be increased by turning the tension nut 184 clockwise so as draw the threaded shaft 186 in the direction E which, in turn, displaces the turnbuckle 180 in the direction E. To decrease the tension, simply turn the tension nut 184 counterclockwise. Once the desired tension is achieved, the user may merely tighten the lock nut 182 back against tension nut 184.

It is to be understood that the present invention is not limited to the sole embodiment described above, but encompasses any and all embodiments within the scope of the following claims.

We claim:

1. An exercise apparatus comprising:

a base;

a crank assembly rotatably supported by said base, said crank assembly including a plurality of unidirectional bearings joining said crank assembly to said base, said unidirectional bearings limiting a rotation of said crank assembly to a single direction;

a platform, rotatably engaged with said crank assembly, for supporting a user;

a biasing assembly, operatively coupled to said crank assembly and said base, for applying a rotational force to said crank assembly, said rotational force being variable in accordance with a position of said crank assembly;

said biasing assembly including:

a spring for producing the rotational force being applied to said crank assembly;

a sprocket for applying the rotational force to said crank assembly, said sprocket rotatably engaging said crank assembly; and a chain for delivering the rotational force from said spring to said sprocket, said chain having a first segment engaging said sprocket and a second segment connected to said base by said spring; and a handle for a user to grasp, said handle being secured to said base.

2. The exercise apparatus according to claim 1, wherein said platform includes:

a rigid core having an outer surface and being rotatably engaged with said crank assembly; and a padding material joined to said outer surface.

3. An exercise apparatus comprising:

a base;

a crank assembly rotatably supported by said base, said crank assembly including a plurality of unidirectional bearings joining said crank assembly to said base, said unidirectional bearings limiting a rotation of said crank assembly to a single direction, said rotation of said crank assembly including a first and second half cycle, said first halve cycle being defined by a downward stroke and said second half cycle being defined by an upward stroke;

a platform, rotatably engaged with said crank assembly, for supporting a user;

means for receiving and retaining a user's foot positioned atop said platform, said retaining means being adjustable to the user's foot;

a biasing assembly, operatively coupled to said crank assembly and said base, said biasing assembly including means for applying a rotational force to said crank assembly, said force applying means including means for accumulating energy upon said downward stroke of said crank assembly and means for delivering energy upon said upward stroke of said crank assembly; and a handle for a user to grasp, said handle being secured to said base.

4. The exercise apparatus according to claim 1, wherein said base includes:

left and right longitudinal rods positioned in a substantially parallel and spaced apart relationship; and front and rear laterally extending rods positioned in a substantially parallel and spaced apart relationship, said front and rear laterally extending rods further connecting said left and right longitudinal rods so as to form a substantially rectangular and planar frame structure.

5. The exercise apparatus according to claim 1, wherein said crank assembly includes:

a first crank rotatably joined to said base by a first of said plurality of unidirectional bearings;

a second crank rotatably joined to said base by a second of said plurality of unidirectional bearings, said first crank being laterally spaced from, and axially aligned with, said second crank; and a laterally disposed connecting rod joining said first crank to said second crank for rotatably supporting said platform.

6. The exercise apparatus according to claim 1, wherein said base includes means for anchoring said force applying means to said base, said anchoring means being attached to said base and being engagable with said force applying means.

7. The exercise apparatus according to claim 1, wherein said force applying means includes means for adjusting the rotational force applied to said crank assembly, said force adjusting means being attached to said force applying means and being engagable with said base.

8. The exercise apparatus according to claim 1, wherein said handle includes a standard rigidly secured to said base.

9. The exercise apparatus according to claim 1, further including:

a seat assembly for supporting a user's upper body, means for removably attaching to said seat assembly to said base, said seat assembly being pivotally adjustable.

10. The exercise apparatus according to claim 1, wherein said rotation of said crank assembly includes a first and second half cycle, said first halve cycle being defined by a downward stroke and said second half cycle being defined by an upward stroke, and wherein said force applying means includes means for accumulating energy upon said downward stroke of said crank assembly and means for delivering energy upon said upward stroke of said crank assembly.

* * * * *